US011620927B2

(12) United States Patent
Sung et al.

(10) Patent No.: US 11,620,927 B2
(45) Date of Patent: Apr. 4, 2023

(54) DISPLAY DEVICE AND DRIVING METHOD THEREOF

(71) Applicant: SAMSUNG DISPLAY CO., LTD., Yongin-si (KR)

(72) Inventors: Si Duk Sung, Yongin-si (KR); Dae Sik Lee, Yongin-si (KR); Sang Hyun Lee, Yongin-si (KR); Myeong Su Kim, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/460,779

(22) Filed: Aug. 30, 2021

(65) Prior Publication Data

US 2022/0277680 A1 Sep. 1, 2022

(30) Foreign Application Priority Data

Feb. 26, 2021 (KR) ..... 10-2021-0026884

(51) Int. Cl.
*G09G 3/20* (2006.01)

(52) U.S. Cl.
CPC ..... *G09G 3/20* (2013.01); *G09G 2310/027* (2013.01); *G09G 2340/16* (2013.01); *G09G 2360/16* (2013.01)

(58) Field of Classification Search
CPC ..... G09G 3/20; G09G 2310/027; G09G 2340/16; G09G 2360/16
See application file for complete search history.

(56) References Cited

U.S. PATENT DOCUMENTS

| | | | | |
|---|---|---|---|---|
| 8,125,420 | B2 | 2/2012 | Arkhipov et al. | |
| 9,257,072 | B2 | 2/2016 | Han | |
| 9,269,301 | B2 | 2/2016 | Lee et al. | |
| 9,900,586 | B2 | 2/2018 | Koh et al. | |
| 2007/0052667 | A1* | 3/2007 | Zhou | G09G 3/344 345/107 |
| 2008/0111783 | A1* | 5/2008 | Chuang | G09G 3/3406 345/102 |
| 2015/0187254 | A1* | 7/2015 | Lee | G09G 3/2022 345/76 |
| 2015/0348457 | A1* | 12/2015 | Ito | G09G 3/3677 345/89 |
| 2018/0122283 | A1* | 5/2018 | Kim | G09G 3/2003 |
| 2018/0252966 | A1* | 9/2018 | Kumamoto | G09F 9/00 |

(Continued)

FOREIGN PATENT DOCUMENTS

| | | |
|---|---|---|
| KR | 10-1352966 | 1/2014 |
| KR | 10-1707586 | 2/2017 |

(Continued)

*Primary Examiner* — Sejoon Ahn
(74) *Attorney, Agent, or Firm* — F. Chau & Associates, LLC

(57) ABSTRACT

A display device includes a scale factor provider, a grayscale converter, and pixels. The scale factor provider calculates an n-th scale factor based on n-th input grayscales received during an n-th frame period. The grayscale converter calculates (n+p)th output grayscales by applying the n-th scale factor to (n+p)th input grayscales received during an (n+p)th frame period in a first mode. The pixels output light to display an image based on the (n+p)th output grayscales, where n is an integer greater than 0 and p is an integer greater than 1.

20 Claims, 7 Drawing Sheets

(56) References Cited

U.S. PATENT DOCUMENTS

| | | | | |
|---|---|---|---|---|
| 2018/0254015 | A1* | 9/2018 | Suyama | H01L 29/7869 |
| 2018/0372499 | A1* | 12/2018 | Ali | G06T 7/248 |
| 2019/0206356 | A1* | 7/2019 | Kim | G09G 3/3688 |
| 2019/0237024 | A1* | 8/2019 | Chen | G09G 3/3225 |

FOREIGN PATENT DOCUMENTS

| | | |
|---|---|---|
| KR | 10-2050518 | 12/2019 |
| KR | 10-2061554 | 1/2020 |

* cited by examiner

DISPLAY DEVICE AND DRIVING METHOD THEREOF

CROSS-REFERENCE TO RELATED APPLICATION

The application claims priority to and the benefit of Korean Patent Application No. 10-2021-0026884, filed Feb. 26, 2021, which is hereby incorporated by reference in its entirety for all purposes as if fully set forth herein.

BACKGROUND

1. Field of the Invention

One or more embodiments described herein relate to a display device and a method of driving a display device.

2. Description of the Related Art

A variety of displays have been developed. Examples include liquid crystal displays and organic light emitting displays. These displays generate images based on image frame data, which provides an indication of the grayscale values of light to be output from each pixel. When an image frame includes only high grayscale values (e.g., above a certain level), an overcurrent condition may occur which causes display current to exceed an allowable range. When an overcurrent condition is expected to occur, grayscale values may be scaled down to adjusted the current back to within the allowable range.

However, when a display operates without a frame memory, a scale factor (based on the grayscale values of a current image frame) cannot be applied to the current image frame. This is because the current image frame cannot be delayed. This may cause various inefficiencies and performance limitations. For example, when a black image and a white image are switched in units of frames, it is not possible for the display to prevent the overcurrent condition.

SUMMARY

In accordance with one or more embodiments, a display device includes a scale factor provider configured to calculate an n-th scale factor based on n-th input grayscales received during an n-th frame period; a grayscale converter configured to calculate (n+p)th output grayscales by applying the n-th scale factor to (n+p)th input grayscales received during an (n+p)th frame period in a first mode; and pixels configured to output light to display an image based on the (n+p)th output grayscales, wherein n is an integer greater than 0 and wherein p is an integer greater than 1.

In accordance with one or more embodiments, a method of driving a display device includes calculating an n-th scale factor based on n-th input grayscales received during an n-th frame period; calculating (n+p)th output grayscales by applying the n-th scale factor to (n+p)th input grayscales received during an (n+p)th frame period in a first mode; and displaying an image by pixels based on the (n+p)th output grayscales, herein n is an integer greater than 0 and wherein p is an integer greater than 1.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION

Figure 1:
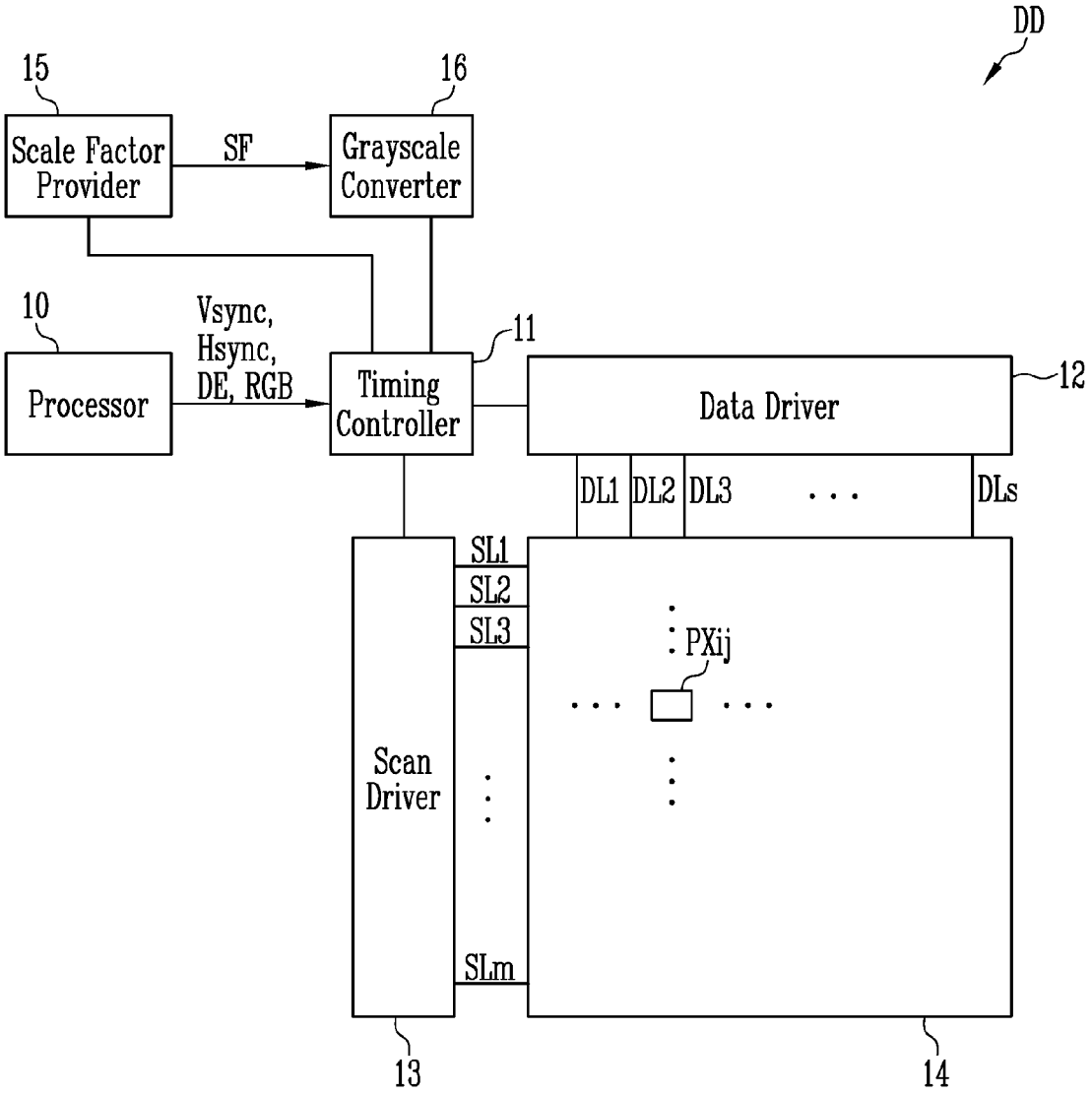
FIG. 1 illustrates an embodiment of a display device.

Hereinafter, various embodiments of the present invention will be described in detail with reference to the accompanying drawings so that those of ordinary skill in the art may easily implement the present invention. The present invention may be embodied in various different forms and is not limited to the embodiments described herein. In order to clearly describe the present invention, parts that are not related to the description are omitted, and the same or similar components are denoted by the same reference numerals throughout the specification. Therefore, the reference numerals described above may also be used in other drawings.

In addition, the size and thickness of each component shown in the drawings are arbitrarily shown for convenience of description, and thus the present invention is not necessarily limited to those shown in the drawings. In the drawings, thicknesses may be exaggerated to clearly express the layers and regions. In addition, in the description, the expression "is the same" may mean "substantially the same". That is, it may be the same enough to convince those of ordinary skill in the art to be the same. In other expressions, "substantially" may be omitted.

FIG. 1 illustrates an embodiment of a display device DD which may include a processor 10, a timing controller 11, a data driver 12, a scan driver 13, a pixel unit 14, a scale factor provider 15, and a grayscale converter 16.

The processor 10 may provide various signals for controlling the display device DD. Examples include a vertical synchronization signal Vsync, a horizontal synchronization signal Hsync, a data enable signal DE, and input grayscale values (or grayscales) RGB. In one embodiment, the processor 10 may include a graphics processing unit (GPU), a central processing unit (CPU), an application processor (AP), or the like. The processor 10 may be implemented by one integrated circuit chip (IC) or a plurality of ICs.

In operation, the processor 10 may supply the input grayscales RGB in active periods of frame periods. In this case, the processor 10 may indicate whether the input grayscales RGB are supplied using the data enable signal DE. For example, the data enable signal DE may be at an enable level while the input grayscales RGB are supplied and at a disable level during one or more remaining periods. The data enable signal DE may include, for example, pulses at the enable level in units of horizontal periods in each active period. The input grayscales RGB may be supplied in units of horizontal lines in response to a pulse at the enable level of the data enable signal DE. In one embodiment, a horizontal line may corresponding to pixels (for example, a pixel row) connected to the same scan line. In one embodiment, the horizontal line may correspond to pixels having scan transistors connected to the same scan line. The scan transistor may be, for example, a transistor having a source or drain electrode connected to a data line and a gate electrode connected to a scan line.

Each cycle of the vertical synchronization signal Vsync may correspond to a respective frame period. For example, the vertical synchronization signal Vsync may indicate an active period of a corresponding frame period at a logic high level and may indicate a blank period of a corresponding frame period at a logic low level. Each cycle of the horizontal synchronization signal Hsync may correspond to each horizontal period.

The timing controller 11 may receive the vertical synchronization signal Vsync, the horizontal synchronization signal Hsync, the data enable signal DE, and the input grayscales RGB from the processor 10. The timing controller 11 may supply control signals corresponding to specifications of the data driver 12, the scan driver 13, the pixel unit 14, the scale factor provider 15, and the grayscale converter 16. In addition, the timing controller 11 may provide input grayscales RGB to the scale factor provider 15 and the grayscale converter 16. The timing controller 11 may provide output grayscales received from the grayscale converter 16 to the data driver 12.

The scale factor provider 15 may calculate a scale factor SF based on the input grayscales received during each frame period. For example, the scale factor provider 15 may calculate an n-th scale factor SF based on n-th input grayscales received during an n-th frame period, where n may be an integer greater than 0. The n-th input grayscales may constitute an n-th image frame.

In one embodiment, the scale factor SF may be a value of 0 or more and 1 or less. The scale factor SF may be a value of 0% or more and 100% or less. In addition, a range of the scale factor SF and an expression method thereof may be variously defined, for example, according to the configuration, driving method, and/or other features and specifications of the display device DD.

The scale factor provider 15 may prevent an overcurrent condition from occurring (e.g., may prevent an excessive current that may cause damage from flowing through the display device DD) by adjusting the scale factor SF so that a global current does not exceed a current limit value. In one embodiment, the current flowing through a light emitting diode of each pixel PXij may be defined as a branch current, and the global current may be based on the sum of branch currents of all pixels. For example, a global current may correspond to the current flowing through a first power source line ELVDDL or a second power source line ELVSSL before branching to the pixels (e.g., see FIG. 2).

The grayscale converter 16 may convert the input grayscales RGB to output grayscales by applying the scale factor SF to the input grayscales RGB. For example, the grayscale converter 16 may calculate the output grayscales by multiplying the input grayscales RGB by a corresponding scale factor SF. In one embodiment, the grayscale converter 16 may generate the output grayscales by reducing the input grayscales RGB at a ratio according to the scale factor SF. Thus, for example, the output grayscales may be less than or equal to the input grayscales RGB.

The grayscale converter 16 may differently determine a time interval between a frame period (in which the input grayscales RGB are received) and a frame period) in which the scale factor SF applied to the input grayscales RGB is generated) according to a display mode. The display mode may include, for example, at least a first mode and a second mode. The processor 10 may provide a mode signal indicating the first mode or the second mode to the timing controller 11. For example, the first mode may be a Motion Picture Response Time (MPRT) improvement mode and the second mode may be a normal mode.

In an embodiment, in the first mode, the grayscale converter 16 may calculate (n+p)th output grayscales by applying the n-th scale factor to (n+p)th input grayscales received during an (n+p)th frame period, where p may be an integer greater than 1. For example, the grayscale converter 16 may calculate the (n+p)th output grayscales constituting a corrected (n+p)th image frame by applying the n-th scale factor based on the n-th image frame to the (n+p)th input grayscales constituting an (n+p)th image frame.

In an embodiment, in the second mode, the grayscale converter 16 may calculate the output grayscales by applying the n-th scale factor to the input grayscales received during an (n+q)th frame period, where q may be an integer greater than 0 and less than p. For example, the grayscale converter 16 may calculate (n+q)th output grayscales constituting a corrected (n+q)th image frame by applying the n-th scale factor based on the n-th image frame to (n+q)th input grayscales constituting an (n+q)th image frame.

The data driver 12 may generate data voltages to be provided to data lines DL1, DL2, DL3, and DLs using the output grayscales and the control signals, where s may be an integer greater than 0. For example, the data driver 12 may sample the output grayscales using a clock signal and apply the data voltages corresponding to the output grayscales to the data lines DL1 to DLs in units of pixel rows. A pixel row may correspond, for example, to pixels connected to the same scan line.

The scan driver 13 may receive a clock signal, a scan start signal, and/or other signals from the timing controller 11 to generate scan signals, which are to be provided to scan lines SL1, SL2, SL3, and SLm, where m may be an integer greater than 0.

The scan driver 13 may sequentially supply the scan signals having a turn-on level pulse to the scan lines SL1 to SLm. The scan driver 13 may include scan stages configured in the form of a shift register. The scan driver 13 may generate the scan signals by sequentially transferring the scan start signal in the form of a turn-on level pulse to the next scan stage under control of the clock signal.

The pixel unit 14 may include the pixels. Each pixel PXij may be connected to a corresponding data line and a corresponding scan line, where i and j may be integers greater than 0. The pixel PXij may have a scan transistor connected to an i-th scan line and a j-th data line.

The display device DD may further include an emission driver. In one embodiment, the emission driver may receive a clock signal, an emission stop signal, and/or other signals from the timing controller 11 to generate emission signals to be provided to emission lines. For example, the emission driver may include emission stages connected to the emission lines. In one embodiment, the emission stages may be configured in the form of a shift register. For example, a first emission stage may generate an emission signal of a turn-off level based on the emission stop signal of the turn-off level. The remaining emission stages may sequentially generate emission signals of the turn-off level based on the emission signal of the turn-off level of a previous emission stage.

When the display device DD includes the emission driver, each pixel PXij may further include a transistor connected to an emission line. The transistor may be turned off during a data writing period of each pixel PXij to prevent the pixel PXij from emitting light. Hereinafter, it is assumed that the emission driver is not provided.

Figure 2:
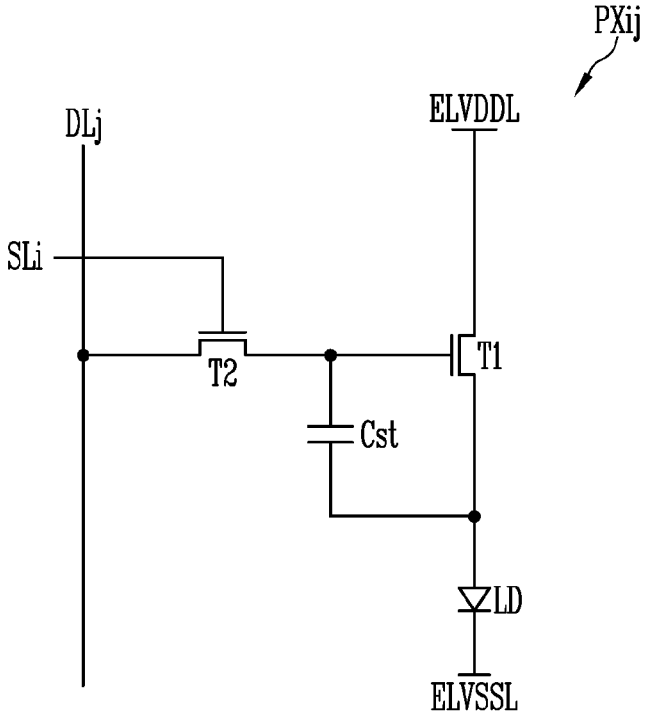
FIG. 2 illustrates an embodiment of a pixel.

FIG. 2 illustrates an embodiment of pixel PXij which may include transistors T1 and T2, a storage capacitor Cst, and a light emitting diode LD. Hereinafter, a pixel circuit including N-type transistors is described as an example. However, a pixel circuit including P-type transistors may be implemented, for example, by changing the polarity of one or more voltages applied to gate terminals of the transistors. In one embodiment, the pixel circuit may include a combination of one or more P-type transistors and one or more N-type transistors. A P-type transistor may generally refer to a transistor in which the amount of current to be conducted increases when a voltage difference between a gate electrode and a source electrode increases in a negative direction. An N-type transistor may generally refer to a transistor in which the amount of current to be conducted increases when the voltage difference between the gate electrode and the source electrode increases in a positive direction. The transistors may be configured in various forms including, but not limited to, a thin film transistor (TFT), a field effect transistor (FET), and a bipolar junction transistor (BJT).

A first transistor T1 may have a gate electrode connected to a first electrode of the storage capacitor Cst, a first electrode connected to a first power source line ELVDDL, and a second electrode connected to a second electrode of the storage capacitor Cst. The first transistor T1 may be referred to as a driving transistor.

A second transistor T2 may have a gate electrode connected to an i-th scan line SLi, a first electrode connected to a j-th data line DLj, and a second electrode connected to the gate electrode of the first transistor T1. The second transistor T2 may be referred to as a scan transistor.

The first electrode of the storage capacitor Cst may be connected to the gate electrode of the first transistor T1, and the second electrode may be connected to the second electrode of the first transistor T1.

The light emitting diode LD may have an anode connected to the second electrode of the first transistor T1 and a cathode connected to a second power source line ELVSSL. The light emitting diode LD may include an organic light emitting diode, an inorganic light emitting diode, a quantum dot/well light emitting diode, or the like. FIG. 2 shows an example where pixel PXij includes one light emitting diode LD. In one embodiment, pixel PXij may include a plurality of light emitting diodes connected in series, in parallel, or in series and parallel.

A first power source voltage may be applied to the first power source line ELVDDL, and a second power source voltage may be applied to the second power source line ELVSSL. For example, during a period in which an image is displayed, the first power source voltage may be greater than the second power source voltage.

When a scan signal having the turn-on level (e.g., logic high level) is applied through the scan line SLi, the second transistor T2 may be turned on. In this case, a data voltage applied to the data line DLj may be stored in the first electrode of the storage capacitor Cst.

A positive driving current corresponding to a voltage difference between the first electrode and the second electrode of the storage capacitor Cst may flow between the first electrode and the second electrode of the first transistor T1. Accordingly, the light emitting diode LD may emit light with a luminance corresponding to the data voltage.

When the scan signal having a turn-off level (e.g., logic low level) is applied through the scan line SLi, the second transistor T2 may be turned off and the data line DLj and the first electrode of the storage capacitor Cst may be electrically separated. Accordingly, even if the data voltage of data line DLj is changed, the voltage stored in the first electrode of the storage capacitor Cst may not be changed.

This embodiment may be applied not only to pixel PXij of FIG. 2, but also to a pixel having other pixel circuits. For example, when the display device DD further includes an emission driver, the pixel PXij may further include a transistor connected to the emission line.

Figure 3:
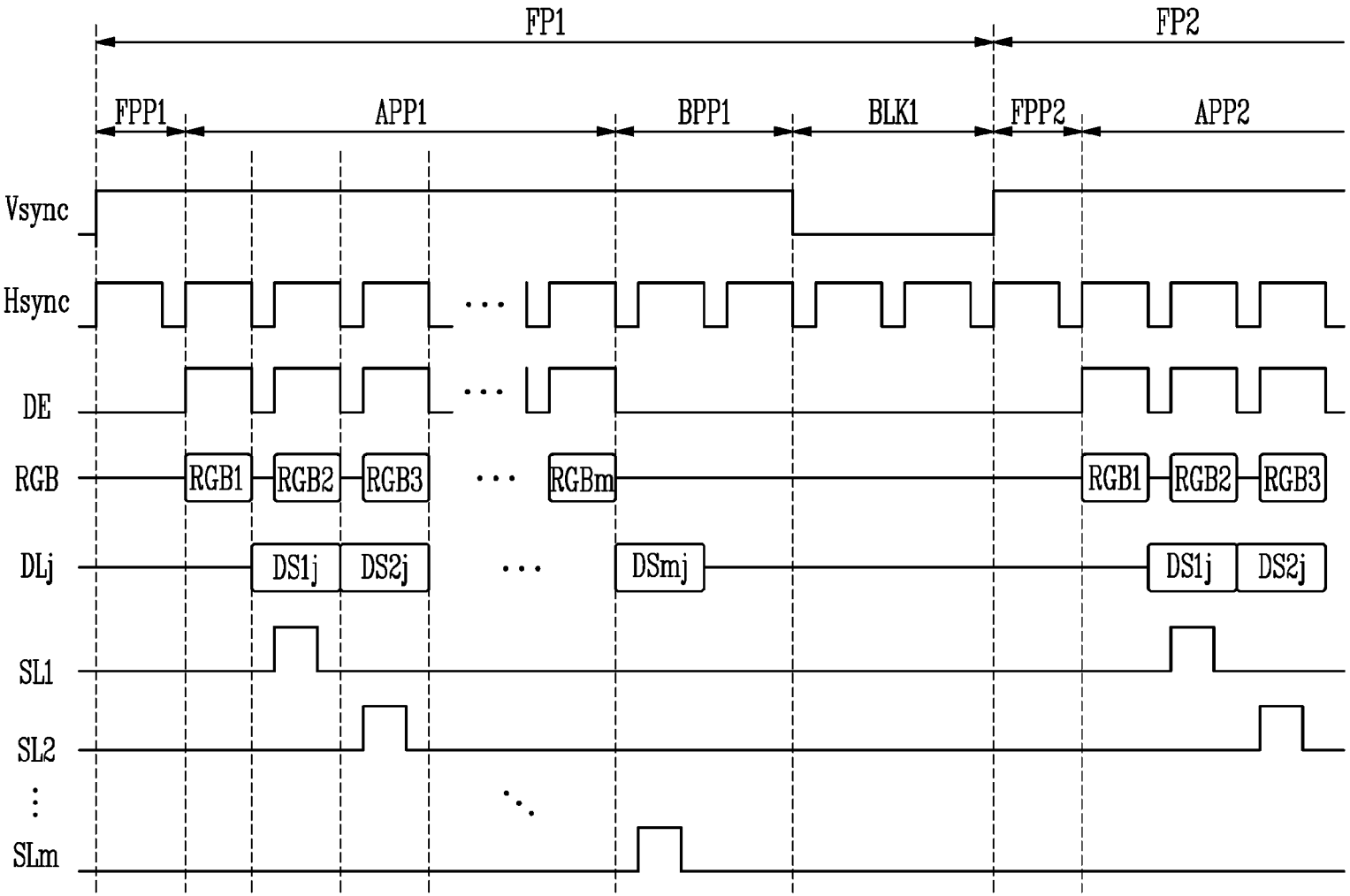
FIG. 3 illustrates an embodiment of a method of driving a display device.

FIG. 3 is a timing diagram corresponding to an embodiment of a method of driving a display device, which, for example, may correspond to display device DD.

Referring to FIG. 3, consecutive first and second frame periods FP1 and FP2 are shown as an example. The first frame period FP1 may include a first front porch period FPP1, a first active period APP1, a first back porch period BPP1, and a first blank period BLK1. For example, the second frame period FP2 may include a second front porch period FPP2, a second active period APP2, a second back porch period, and a second blank period.

The first front porch period FPP1 may be, for example, a period in which the vertical synchronization signal Vsync is at the logic high level and the data enable signal DE is at the logic low level. This period may be before the supply of input grayscales RGB1, RGB2, RGB3, and RGBm starts.

The first active period APP1 may be, for example, a period in which the vertical synchronization signal Vsync is at the logic high level and the data enable signal DE includes the pulses of the enable level. This period may be one in which the input grayscales RGB1, RGB2, RGB3, and RGBm are supplied.

The first back porch period BPP1 may be, for example, a period in which the vertical synchronization signal Vsync is at the logic high level and the data enable signal DE is at the logic low level. This period may be after supply of the input grayscales RGB1, RGB2, RGB3, and RGBm ends.

The first blank period BLK1 may be, for example, a period in which the vertical synchronization signal Vsync is at the logic low level and the data enable signal DE is at the logic low level. Hereinafter, description will be made based on the first frame period FP1, but this description may be applied equally to other frame periods.

In the first active period APP1, the data enable signal DE having the enable level (for example, the logic high level) may be supplied in units of horizontal periods. In this case, the input grayscales RGB1, RGB2, RGB3, and RGBm in units of horizontal lines (pixel rows) may be supplied in synchronization with the data enable signal DE of the enable level.

The data driver 12 may receive the output grayscales converted from the input grayscales RGB1, RGB2, RGB3, and RGBm from the timing controller 11. According to an embodiment, the data driver 12 may serially receive the output grayscales corresponding to the input grayscales RGB1 in units of horizontal lines. When reception is completed, the data driver 12 may generate the data voltages by latching the output grayscales in parallel. Among these data voltages, a j-th data voltage DS1*j* may be applied to the j-th data line DLj. Similarly, some of the output grayscales corresponding to input grayscales RGB2 may be output as a data voltage DS2*j* in the next horizontal period. Also, some of the output grayscales corresponding to input grayscales RGBm may be output as a data voltage DSmj in the next horizontal period.

As the scan signals having the turn-on level (for example, the logic high level) are sequentially applied to the scan lines SL1, SL2 and SLm, the data voltages applied to the data lines may be written to corresponding pixels. For example, when the scan signal having the turn-on level is applied to the scan line SL1, data voltages DS1*j*, . . . may be written to the pixels of a first horizontal line (or pixel row). Next, when the scan signals of the turn-on level are applied to the scan line SL2, data voltages DS2*j*, . . . may be written to the pixels of a second horizontal line. By repeating this, when the scan signals of the turn-on level are applied to the last scan line SLm, data voltages DSmj, . . . may be written to the pixels of the last horizontal line.

In the first blank period BLK1, the data enable signal DE of the disable level (for example, the logic low level) may be supplied. In this case, supply of the input grayscales RGB1 to RGBm may be stopped.

Figure 4:
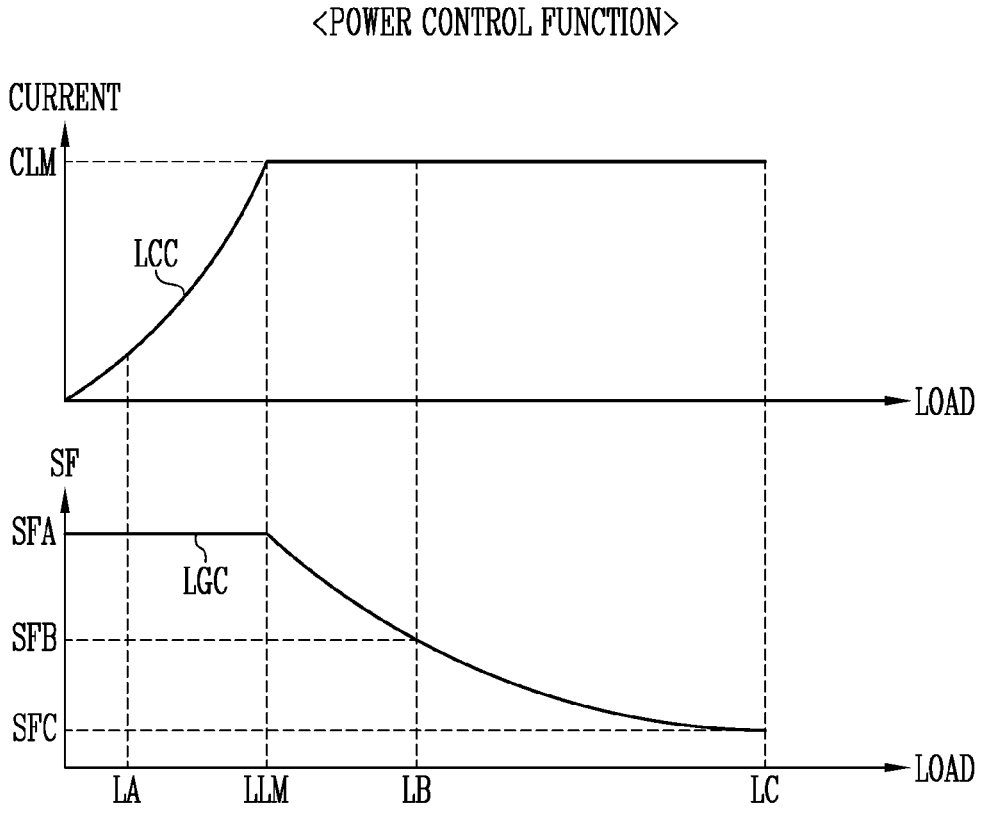
FIG. 4 illustrates an embodiment of the operation of a scale factor provider.

FIG. 4 is a diagram illustrating an embodiment of the operation of the scale factor provider 15. At the top portion of FIG. 4, the graph LCC shows a target global current that should flow to the display device DD in response to each load value LOAD. At the bottom portion of FIG. 4, the graph LGC shows the scale factor SF generated by the scale factor provider 15 in response to each load value LOAD. The values shown in FIG. 4 are just examples and may be different in other embodiments.

In graphs LCC and LGC, the load value LOAD at one time point may correspond to the input grayscales of one image frame. For example, the load value LOAD at one time point may be a value obtained by summing gamma conversion values of the input grayscales of one image frame. In one embodiment, the load value may be obtained by summing the gamma conversion values of the n-th input grayscales. The gamma conversion values may refer to values obtained by converting the input grayscales to a luminance domain according to a selected gamma value. For example, the gamma value may be 2.0, 2.2, 2.4, or the like, and may be selected by a user or an algorithm. In one embodiment, the load value LOAD at one time point may be a value obtained by summing the input grayscales of one image frame.

When the load value LOAD increases according to an image pattern (for example, when an image gradually becomes brighter), the branch current of the pixels increases, so that the global current flowing through the first power source line ELVDDL may also increase.

The scale factor provider 15 may provide the scale factor SF so that the global current is less than a current limit value CLM. For example, the scale factor provider 15 may maintain the scale factor SF to the maximum when the global current is less than the current limit value CLM. In this case, the scale factor SF may be 1 (or 100%). The scale factor provider 15 may prevent an increase in current flowing through the first power source line ELVDDL, by reducing the scale factor SF when the global current exceeds the current limit value CLM. In this case, the scale factor SF may be less than 1 (or 100%). For example, in the image frame having the load value greater than a load value LLM corresponding to the current limit value CLM, the luminance corresponding to each grayscale may be decreased as the load value increases. In this case, the scale factor SF may be less than 1 (or 100%). For example, in the image frame having the load value greater than the load value LLM corresponding to the current limit value CLM, the luminance corresponding to each grayscale may be decreased as the load value increases.

In the case of pattern "A", for example, since the current flowing in response to the load value LA is less than the current limit value CLM, the scale factor provider 15 may provide the scale factor SFA of 1. Accordingly, the pixels corresponding to a white grayscale in pattern "A" may emit light with a maximum luminance (for example, 1000 nits).

However, in the case of pattern "B", since the current flowing in response to the load value LB needs to be limited to be less than the current limit value CLM, the scale factor provider 15 may provide the scale factor SFB less than 1. Accordingly, the pixels corresponding to the white grayscale in pattern "B" may emit light with a luminance lower than the maximum luminance (for example, 500 nits).

In addition, in a case of pattern "C", since the current flowing in response to the load value LC is to be limited to be less than the current limit value CLM, the scale factor provider 15 may provide the scale factor SFB to be less than 1 and also less than the scale factor SFC. For example, the scale factor provider 15 may calculate the n-th scale factor to be smaller as the load value of the n-th input grayscales increases. Accordingly, pixels corresponding to the white grayscale in pattern "C" may emit light with a luminance lower than the maximum luminance (for example, 250 nits).

Figure 5:
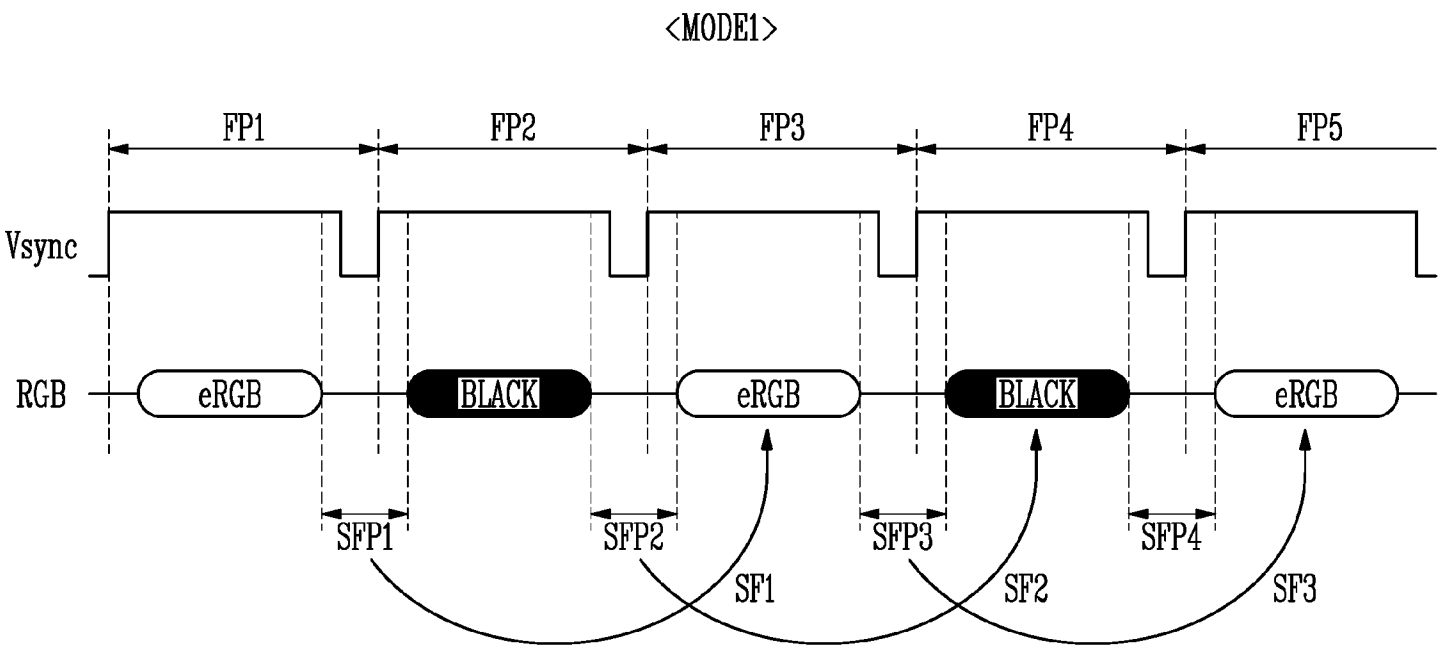
FIG. 5 illustrates an embodiment of a first mode.

FIG. 5 illustrates an embodiment of a first mode of operation of the display device DD. In FIG. 5, frame periods FP1, FP2, FP3, FP4, and FP5 in the first mode are shown as an example. Also, the first mode may be the Motion Picture Response Time (MPRT) improvement mode. One reason why the MPRT can be improved in the first mode will be described with reference to FIG. 7.

In the first mode, a first image may be repeatedly provided at a predetermined cycle. For example, the first mode may be one in which p frame periods are one cycle and the first image having the same (or substantially the same) input grayscales RGB may be provided for each cycle, where p may be an integer greater than 1. The first image may be a black image. Thus, all of the input grayscales RGB of a first image frame corresponding to the first image may be black grayscales (for example, 0 grayscales). FIG. 5 shows a case where p is 2 as an example.

In the first mode, an effective image may be provided in the remaining frame periods FP1, FP3, and FP5 except for the frame periods FP2 and FP4 in which the first image is provided. The effective image may include effective input grayscales eRGB. The effective image may be a general image and, for example, may be an image that the user wants to watch.

The scale factor provider 15 may receive all of the input grayscales RGB of a current frame period, and may calculate the scale factor SF of the current frame period before reception of the input grayscales RGB of the next frame period starts. For example, the scale factor provider 15 may calculate scale factors SF1, SF2, SF3, . . . in countable periods SFP1, SFP2, SFP3, and SFP4. A countable period may include, for example, a back porch period, a blank period and a front porch period. An example case where n is 1 and p is 2 will be described with reference to FIG. 5.

The scale factor provider 15 may receive all of the input grayscales eRGB of an n-th frame period FP1, and may calculate an n-th scale factor SF1 before the reception of input grayscales BLACK of an (n+1)th frame period FP2 starts (SFP1).

In the first mode, the grayscale converter 16 may calculate the (n+p)th output grayscales by applying the n-th scale factor SF1 to (n+p)th input grayscales eRGB received during an (n+p)th frame period FP3.

The pixels may display the image (e.g., the effective image) based on the (n+p)th output grayscales. Image frames that are temporally adjacent in the effective image may include similar input grayscales. Accordingly, since the scale factor SF1 of the effective image that is temporally adjacent is applied to the (n+p)th output grayscales corresponding to the effective image, the current limit of FIG. 4 may be appropriately applied to prevent the overcurrent. If the scale factor SF2 of the first image is applied to the (n+p)th input grayscales eRGB corresponding to the effective image, the scale factor SF of a maximum value may be applied to the (n+p)th input grayscales eRGB so that the overcurrent may occur.

According to the above-described embodiment, since the display device DD can be driven in the first mode without having a frame memory, the cost for configuring the display device DD may be reduced for at least some applications.

As described above, since the display device DD does not have a frame memory, the display device DD cannot display the image frame with a delay. Accordingly, the pixels may start to display the image based on the (n+p)th output grayscales during the (n+p)th frame period FP3. Also, the pixels may end displaying the image based on the (n+p)th output grayscales during an (n+p+1)th frame period FP4. This is because new input grayscales BLACK are written to the pixels in the (n+p+1)th frame period FP4. An example case where n is 2 and p is 2 will be described with reference to FIG. 5.

The scale factor provider 15 may receive all of the input grayscales BLACK of an n-th frame period FP2, and may calculate an n-th scale factor SF2 before the reception of the input grayscales eRGB of an (n+1)th frame period FP3 starts (SFP2).

In the first mode, the grayscale converter 16 may calculate the (n+p)th output grayscales by applying the n-th scale factor SF2 to (n+p)th input grayscales BLACK received during an (n+p)th frame period FP4.

The pixels may display the image (e.g., the first image) based on the (n+p)th output grayscales. As described above, all of the input grayscales BLACK of first images may be the same or substantially the same. Accordingly, since the scale factor SF2 of the first image is applied to the (n+p)th output grayscales corresponding to the first image, the current limit of FIG. 4 may be appropriately applied.

As described above, since the display device DD does not have a frame memory, the display device DD cannot display the image frame with a delay. Accordingly, the pixels may start to display the image based on the (n+p)th output grayscales during the (n+p)th frame period FP4. Also, the pixels may end displaying the image based on the (n+p)th output grayscales during an (n+p+1)th frame period FP5. This is because new input grayscales eRGB are written to the pixels in the (n+p+1)th frame period FP5.

Figure 6:
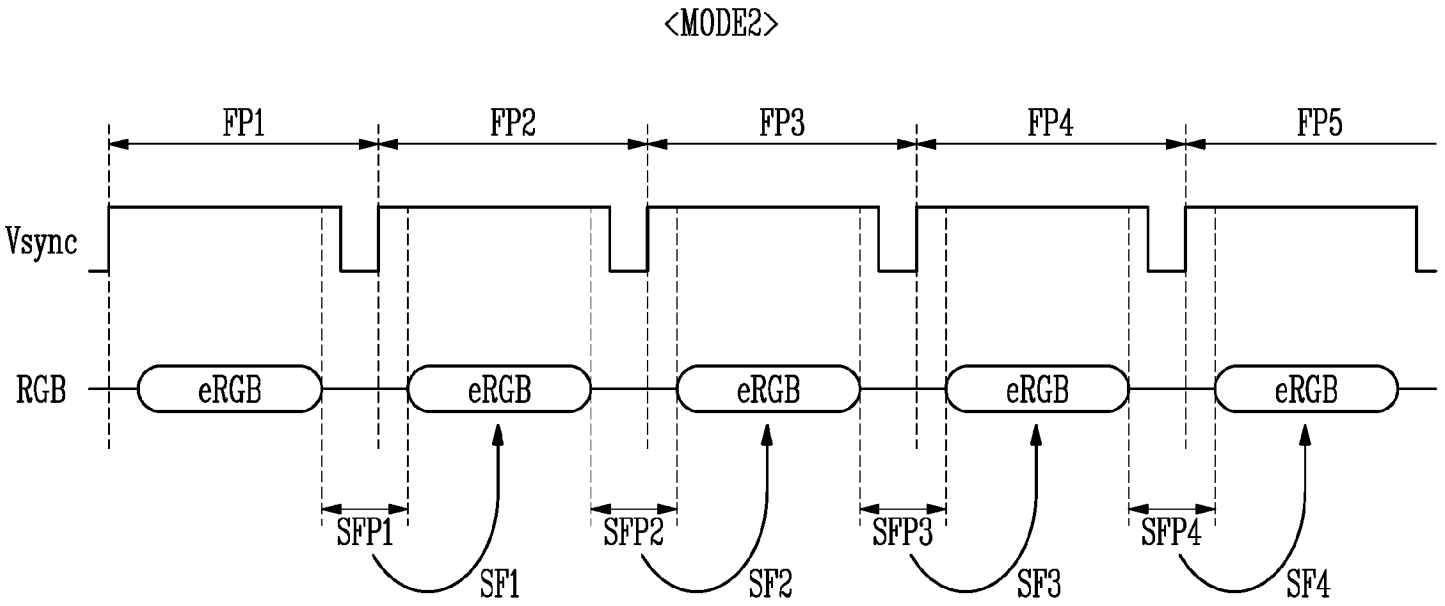
FIG. 6 illustrates an embodiment of a second mode.

FIG. 6 illustrates an embodiment of a second mode of operation of the display device DD. In FIG. 6, frame periods FP1, FP2, FP3, FP4, and FP5 in the second mode are shown as an example. The second mode may be the normal mode, in which all of the image frames may correspond to effective images. The first image may not be provided in the second mode.

In the second mode, the grayscale converter 16 may calculate the output grayscales by applying the n-th scale factor to the input grayscales received during the (n+q)th frame period, where q may be an integer greater than 0 and less than p. For example, q may be 1.

The grayscale converter 16 may, for example, apply the scale factor SF1 generated in the first frame period FP1 to the input grayscales eRGB received in the second frame period FP2. Similarly, the grayscale converter 16 may apply the scale factor SF2 generated in the second frame period FP2 to the input grayscales eRGB received in the third frame period FP3. Also, in a similar manner, the grayscale converter 16 may apply the scale factor SF3 generated in the third frame period FP3 to the input grayscales eRGB received in the fourth frame period FP4. Similarly, the grayscale converter 16 may apply the scale factor SF4 generated in the fourth frame period FP4 to the input grayscales eRGB received in the fifth frame period FP5.

Since the scale factor SF of an n-th effective image that is temporally adjacent is applied to the (n+p)th output grayscales corresponding to the effective image, the current limit of FIG. 4 may be appropriately applied to prevent an overcurrent condition.

The pixels may start to display the image based on the (n+q)th output grayscales during the (n+q)th frame period. Also, the pixels may end displaying the image based on the (n+q)th output grayscales during an (n+q+1)th frame period.

Figure 7:
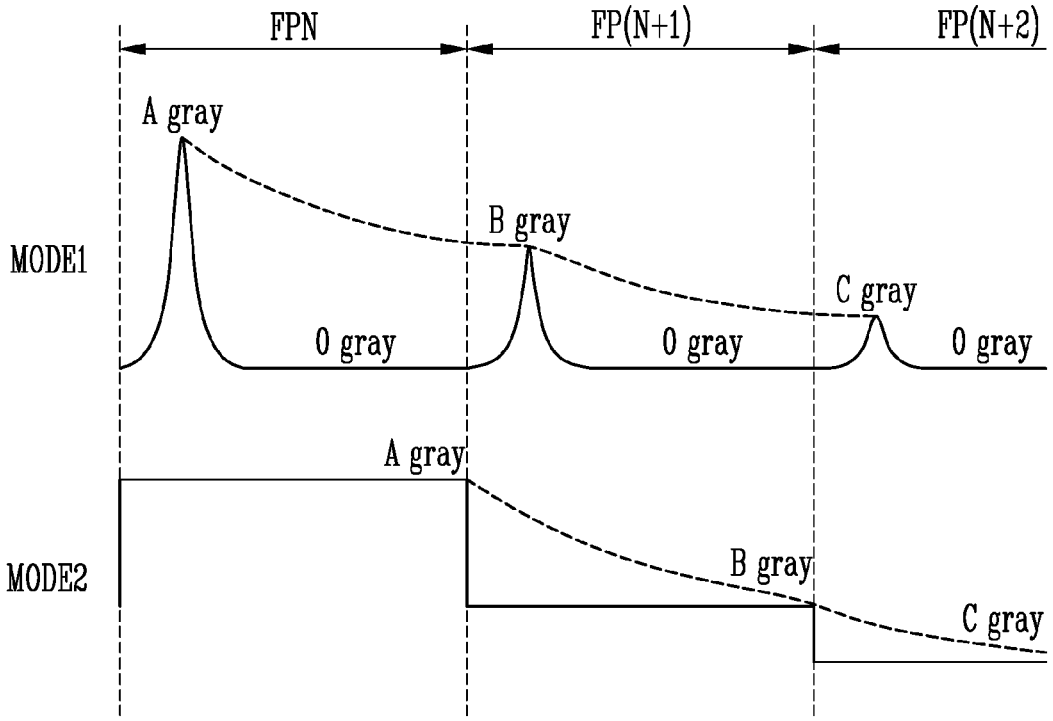
FIG. 7 illustrates an example of a difference in luminance that may be visually recognized according to a display mode for a same image.

FIG. 7 illustrates an example of a difference in luminance that may be visually recognized according to a display mode for the same image. In graphs of a first mode MODE1 and a second mode MODE2, the horizontal axis is based on time and the vertical axis is based on luminance.

For example, it is assumed that one arbitrary pixel PXij emits light with a grayscale A in an N-th frame period FPN, emits light with a grayscale B lower than the grayscale A in an (N+1)th frame period FP(N+1), and emits light with a grayscale C lower than the grayscale B in an (N+2)th frame period FP(N+2). In this case, as shown in FIG. 7, the speed of change in grayscale visually recognized by a person may be faster in the first mode MODE1 than in the second mode MODE2.

For example, when the display device DD displays a moving image in the second mode MODE2, the person may visually recognize the image at a time point that is delayed from a time point when an actual image is displayed. In one embodiment, this may be referred to as the Motion Picture Response Time (MPRT). In order to improve the MPRT, the display device DD may be driven in the first mode MODEL The display device and the driving method thereof according to the present invention can prevent the occurrence of an overcurrent condition in various cases for various patterns, including, for example, a worst pattern even when the frame memory is not provided.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, controller, or other signal processing device which is to execute the code or instructions for performing the method embodiments or operations of the apparatus embodiments herein.

The controllers, processors, providers, converters, drivers, devices, generators, logic, and other signal generating and signal processing features of the embodiments disclosed herein may be implemented, for example, in non-transitory logic that may include hardware, software, or both. When implemented at least partially in hardware, the controllers, processors, providers, converters, drivers, devices, generators, logic, and other signal generating and signal processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, processors, providers, converters, drivers, devices, generators, logic, and other signal generating and signal processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

The drawings referred to heretofore and the detailed description of the invention described above are merely illustrative of the invention. It is to be understood that the invention has been disclosed for illustrative purposes only and is not intended to limit the meaning or scope of the invention as set forth in the claims. Therefore, those skilled in the art will appreciate that various modifications and equivalent embodiments are possible without departing from the scope of the invention. Accordingly, the true technical protection scope of the invention should be determined by the technical idea of the appended claims.

What is claimed is:

1. A display device, comprising:

a scale factor provider configured to calculate an n-th scale factor based on n-th input grayscales received from a processor or a timing controller during an n-th frame period;

a grayscale converter configured to calculate (n+p)th output grayscales by applying the n-th scale factor to (n+p)th input grayscales received from the processor or the timing controller during an (n+p)th frame period in a first mode; and pixels configured to output light to display an image based on the (n+p)th output grayscales, wherein n is an integer greater than 0 and wherein p is an integer greater than 1.

2. The display device of claim 1, wherein the first mode is a mode in which p frame periods are one cycle and a first image having substantially same input grayscales is provided for each cycle.

3. The display device of claim 2, wherein the first image is a black image.

4. The display device of claim 3, wherein the grayscale converter is configured to calculate output grayscales by applying the n-th scale factor to input grayscales received during an (n+q)th frame period in a second mode, and wherein q is an integer greater than 0 and less than p.

5. The display device of claim 4, wherein:

the first mode is a Motion Picture Response Time (MPRT) improvement mode, and the second mode is a normal mode.

6. The display device of claim 1, wherein the scale factor provider is configured to calculate the n-th scale factor after receiving all of input grayscales of the n-th frame period and before the reception of input grayscales of an (n+1)th frame period starts.

7. The display device of claim 1, wherein the pixels are configured to start output of the light to display the image based on the (n+p)th output grayscales during the (n+p)th frame period.

8. The display device of claim 7, wherein the pixels are configured to end output of the light of the image based on the (n+p)th output grayscales during an (n+p+1)th frame period.

9. The display device of claim 1, wherein the scale factor provider is configured to calculate the n-th scale factor smaller as a load value of the n-th input grayscales increases.

10. The display device of claim 9, wherein the load value is a sum of gamma conversion values of the n-th input grayscales.

11. A method of driving a display device, the method comprising:

calculating an n-th scale factor based on n-th input grayscales received from a processor or a timing controller during an n-th frame period;

calculating (n+p)th output grayscales by applying the n-th scale factor to (n+p)th input grayscales received during an (n+p)th frame period from the processor or the timing controller in a first mode; and displaying an image by pixels based on the (n+p)th output grayscales, wherein n is an integer greater than 0 and wherein p is an integer greater than 1.

12. The method of claim 11, wherein the first mode is a mode in which p frame periods are one cycle and a first image having substantially the same input grayscales is provided for each cycle.

13. The method of claim 12, wherein the first image is a black image.

14. The method of claim 13, further comprising:

calculating output grayscales by applying the n-th scale factor to input grayscales received during an (n+q)th frame period in a second mode, wherein q is an integer greater than 0 and less than p.

15. The method of claim 14, wherein:

the first mode is a Motion Picture Response Time (MPRT) improvement mode, and the second mode is a normal mode.

16. The method of claim 11, wherein in the calculating the n-th scale factor, the n-th scale factor is calculated after receiving all of input grayscales of the n-th frame period and before the reception of input grayscales of an (n+1)th frame period starts.

17. The method of claim 11, wherein in the displaying the image, the pixels start to display the image based on the (n+p)th output grayscales during the (n+p)th frame period.

18. The driving method of claim 17, wherein the pixels end displaying the image based on the (n+p)th output grayscales during an (n+p+1)th frame period.

19. The driving method of claim 11, wherein in the calculating the n-th scale factor, the n-th scale factor is calculated smaller as a load value of the n-th input grayscales increases.

20. The driving method of claim 19, wherein the load value is a sum of gamma conversion values of the n-th input grayscales.

* * * * *